US005390445A

United States Patent [19]

Giovanazzi et al.

[11] Patent Number: 5,390,445

[45] Date of Patent: Feb. 21, 1995

[54] KNIFE SHARPENING MACHINE

[75] Inventors: Enzo Giovanazzi, Spiazzo; Loredana Cremascoli, Frazione Mortaso, 200, 38088 Spiazzo - Trento, both of Italy

[73] Assignee: Loredana Cremascoli, Spiazzo, Italy

[21] Appl. No.: 842,379

[22] PCT Filed: Jul. 20, 1990

[86] PCT No.: PCT/EP90/01193

§ 371 Date: Apr. 29, 1992

§ 102(e) Date: Apr. 29, 1992

[87] PCT Pub. No.: WO91/04132

PCT Pub. Date: Apr. 4, 1991

[30] Foreign Application Priority Data

Sep. 22, 1989 [IT] Italy ..... 21796-A/89

[51] Int. Cl.[6] ..... B24B 3/36

[52] U.S. Cl. ..... 451/194; 451/196; 451/45

[58] Field of Search ..... 51/33 R, 33 HK, 80 R, 51/81 R, 81 BS, 285, 326, 327, 328

[56] References Cited

U.S. PATENT DOCUMENTS

| | | | |
|---|---|---|---|
| 806,551 | 12/1905 | Martin . | |
| 1,836,064 | 8/1928 | Boche . | |
| 2,581,157 | 1/1952 | Whitcomb . | |
| 2,617,235 | 11/1952 | Lindahl | 51/80 R |
| 3,610,098 | 10/1971 | Walker | 51/80 R |
| 4,265,055 | 5/1981 | Cartwright . | |

FOREIGN PATENT DOCUMENTS

| | | |
|---|---|---|
| 0168147 | 8/1921 | United Kingdom . |
| 0227902 | 1/1925 | United Kingdom . |

*Primary Examiner*—Jack W. Lavinder

[57] ABSTRACT

This knife sharpening machine comprises a supporting framework (2), means (3) of holding a knife (C) on the framework (2) at a sharpening section (4), a pair of disk grinders (10) acting on the knife at the sharpening section (4) from opposed sides thereof, and motive means (22) for rotatively driving the two grinders (10) in opposite directions. Said grinders (10) are carried movably on the framework (2) each along an arcuate path (P), convexedly to the knife (C) position.

8 Claims, 2 Drawing Sheets

KNIFE SHARPENING MACHINE

TECHNICAL FIELD

This invention relates to a knife sharpening machine, according to the preamble of the main claim.

BACKGROUND ART

Machines of this kind are disclosed in GB-A-168, 147.

It is common practice to set the grinders close together, but not in mutual contact; a knife to be sharpened is moved through the gap between the grinders such that the latter will restore the knife to a sharp edge by their abrasive action.

In this way, fully satisfactory results cannot be attained, however, because of the knife blade acquiring a cross-sectional shape which substantially duplicates the geometry of the two facing grinders, that is, a concave shape of its sides. This feature is objectionable both because it provides no knife edge of zero thickness (thereby requiring an additional finishing step), and because it weakens the sides of the knife blade. Ultimately, the quality of the sharpening action afforded by such prior machines is much poorer than that to be obtained manually by a skilled knife grinder.

DISCLOSURE OF THE INVENTION

It is an object of this invention to provide a knife sharpening machine which can impart a convex profile to the knife blade at the edge region thereof.

This object is achieved, according to the invention, by a knife sharpening machine according to the characterizing clause of the main claim.

Thus, the grinders will process the knife to a convex profile which duplicates the arcuate travel path of the grinders, thereby avoiding all the drawbacks which associate with sharpening to a concave profile.

Advantageously, the arcuate paths travelled by the two grinders are symmetrical about the plane containing the knife.

Also advantageously, the two grinders are held in mutual contact and travel their respective arcuate paths in opposite directions from each other, thereby as one of said grinders, is at work on the edge of the knife, the other grinder is at work on the side thereof.

Preferably, this machine comprises: a table journalled to the framework along a parallel axis to the knife edge and laid on the knife plane, a pair of arms pivoted to the table at symmetrical locations relatively to the table pivot axis, each of said arms carrying a respective one of said grinders, a pair of arcuate profile cams mounted on the framework, a pair of feelers, each mounted to one of the arms at the location of a respective grinder and in contact engagement with a respective one of the profile cams, said table being oscillated so as to reciprocate the grinder holding arms back and forth.

Preferably, the grinders are made of a compressible resilient material and the profile cams are provided with screw means of adjusting their setting on the framework and accommodating the grinder wear.

Further features and advantages of a machine according to the invention will be more clearly understood from the following detailed description of a preferred embodiment thereof, to be read in conjunction with the accompanying drawings.

BEST MODE FOR CARRYING OUT THE INVENTION

Figure 1:
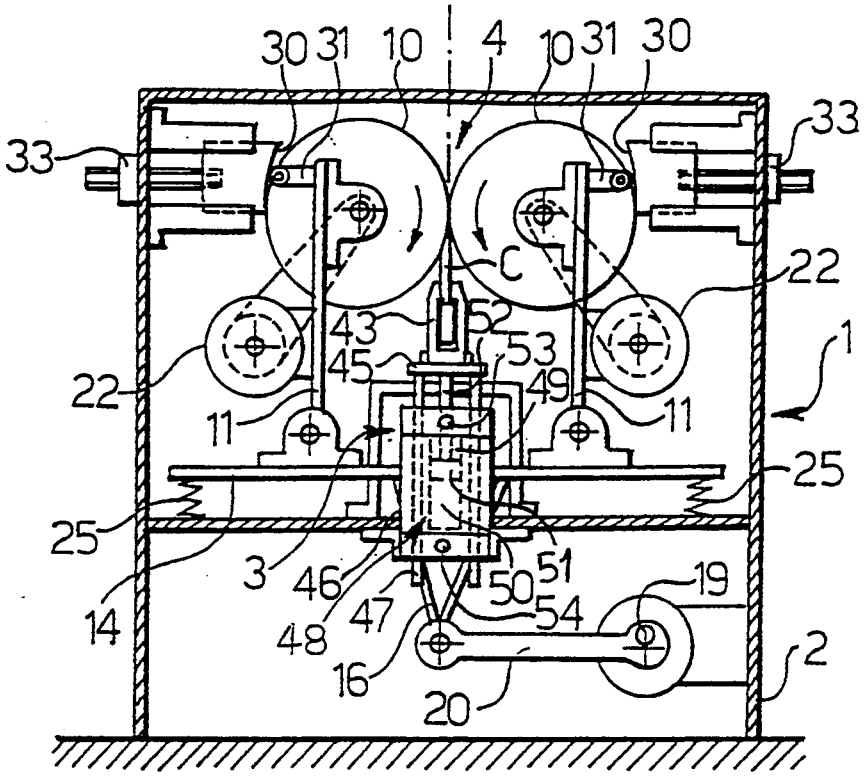
FIGS. 1, 2 and 3 are front views of a machine according to the invention, shown at different stages of its operation.
Figure 2:
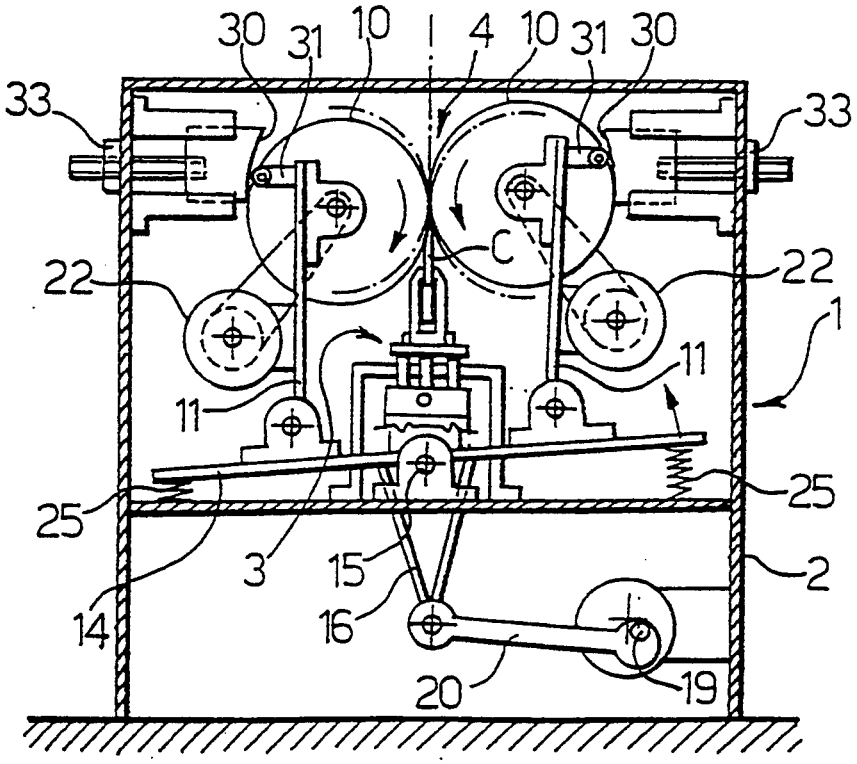
Figure 3:
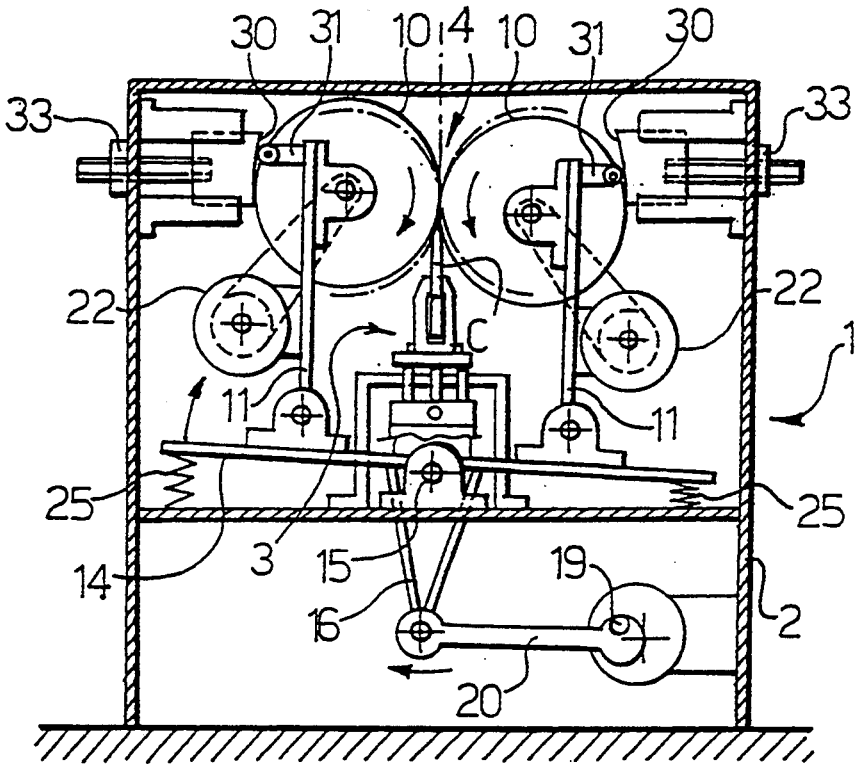

Generally shown at 1 in the drawing views is a knife sharpening machine. The machine 1 comprises a supporting framework 2 of substantially gantry-like construction. The framework 2 carries a means 3 of holding a knife C being sharpened so as to locate the latter at a sharpening section or zone 4. Active at said sharpening section 4 are two disk grinders, both designated 10.

Each of the two grinders 10 is supported rotatively on a respective arm 11 close to one end of the latter; each arm 11 is pivoted, with its opposed end, to a table 14 caused to oscillate about a pivot 15 on the framework 2 relatively to a parallel axis to the knife edge lying within the knife profile.

The two arms 11 are pivoted to the table 14 in symmetrical positions about the pivot 15.

Fast with the table 14 is a center jib 16 which is reciprocated by a rotary eccentric 19 via a connecting rod 20.

Each of the arms 11 has a motor 22 mounted thereto which connects drivingly to the grinder 10 (through a conventional means such as a belt drive) to rotate it.

Two springs 25 are interposed between the table 14 and the framework 2 to act as dampeners.

The grinders 10 are supported movably with respect to the framework 2 such that they will each travel an arcuate path P, convexedly to the position of the knife C. Advantageously, the paths P of the two grinders are symmetrical about the plane containing the knife C. For this purpose, an arcuate profile cam 30 is provided for each respective grinder 10 which is mounted on the framework 2, and a feeler 31, mounted to the arm 11 at a location close to the grinder 10, is provided in contact engagement with the profile cam 30. The settings of the profile cams 30 relatively to the framework 2 are adjustable by means of thread mechanisms 33.

Advantageously, the grinders 10 are of a resilient type, that is formed from a compressible, resilient abrasive material.

To hold the knife C at the sharpening section 4, a holder means 3 is provided. This means may be of a varying type to suit individual requirements, thereby affording operation of the machine 1 in a more or less automated manner. As an example, the drawings show a holder means 3 which comprises a carriage 43 to which the knife C is clamped by conventional clamps (not shown); the carriage 43 fits slidably over a horizontal plate being, in turn, guided slidably in a vertical direction relatively to a body 46 fast with the framework 2, as by means of linear slideways 47. A pneumatic cylinder 48 is formed within the body 46 which has two chambers 49 and 50 separated by a piston 51. The piston 51 is linked to the plate 45 by a connecting rod 52. The chambers 49 and 50 are connected to a conventional pneumatic system by means of respective fittings 53 and 54.

Figure 4:
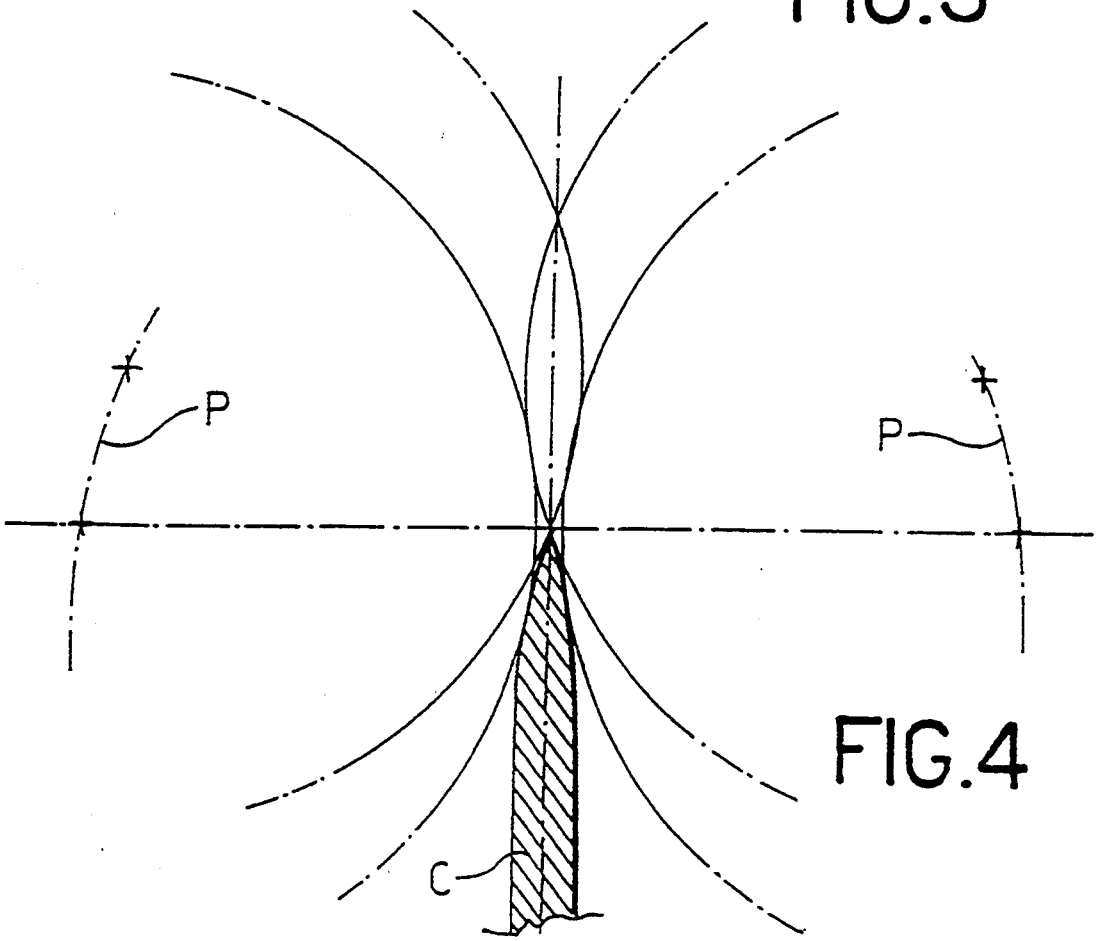
FIG. 4 is a diagram schematically illustrating the operation of the machine in FIG. 1.

In operation, the grinders 10 are rotated, in opposite directions from each other, by their respective motors 22. At the same time, the table 14 is oscillated so as to reciprocate the grinders 10 back and forth along their respective paths P. During this movement, the grinders 10 remain in mutual contact and will shift their processing area on the knife C from the edge to the side of the knife, and vice versa, as shown in FIG. 4.

Using the thread mechanisms 33, the settings of the profile cams 30 may be adjusted, as may the settings of the grinders 10, to urge them a desired amount toward each other; the closer to each other are set the profile cams 30, the more compressed will be the grinders 10, that is squeezed together in the area of mutual contact, to result in increased width of the angle at which the knife edge is being sharpened. Furthermore, the wear of the grinders 10 can be accommodated by the thread mechanisms 33.

The position of the knife C relatively to the grinders 10 can be adjusted through the pneumatic cylinder 48, as can the force urging the knife C against the grinders 10.

As may be appreciated, on the machine 1, a knife C would be ground to a convex profile, since each of the grinders 10 processes one side of the knife C to duplicate the convex profile of the cam 30 thereon.

We claim:

1. A knife sharpening machine comprising a supporting framework (2), holding means (3) for holding a knife (C) on the framework (2) at a sharpening section (4), a pair of disk grinders (10) made of a compressible resilient material arranged to act on the knife (C) at the sharpening section (4) from opposed sides thereof, motive means (22) for rotatively driving the two disk grinders (10) in opposite directions, pivotal support means carrying said disk grinders for pivotal movement on the framework (2) along respective arcuate paths (P), said arcuate paths being convex to each other and symmetrical about a plane adapted to contain the knife (C), wherein the two disk grinders (10) are disposed in mutual contact relationship with a predetermined compression, and drive means connected to said pivotal support means for moving said disk grinders along said respective arcuate paths (P) back and forth in opposite directions from each other, whereby as one of said grinders (10) is at work on a cutting edge of the knife, the other is at work on a side of the knife.

2. A machine according to claim 1, wherein said support means comprises:

a table (14) journalled to the framework (2) about a table axis adapted to be parallel to the knife (C) cutting edge in said plane, a pair of arms (11) pivoted to the table (14) at symmetrical locations relatively to the table (14) pivot axis (15), each of said arms (11) carrying a respective one of said grinders (10);

a pair of arcuate profile cams (30) mounted on the framework (2); and a pair of feelers (31), each mounted to one of the arms (11) adjacent each grinder (10) and in contact engagement with a respective one of the profile cams (30), said table (14) being oscillated so as to reciprocate the grinder (10) holding arms (11) back and forth.

3. A machine according to claim 2, wherein said table (14) is driven through a rotary eccentric (19) acting on a table (14) jib (16) via a connecting rod (20).

4. A machine according to claim 2, further comprising dampener means (25) between said table (14) and said framework (2).

5. A machine according to claim 2, wherein said profile cams (30) are mounted on the framework (2) in an adjustable fashion.

6. A machine according to claim 2, wherein the motive means (22) for each grinder (10) are mounted to respective ones of the arms (11).

7. A machine according to claim 1, wherein said knife (C) holder means (3) comprises a slideway wherealong the knife is manually caused to slide.

8. A machine according to claim 1, wherein said knife (C) holder means (3) comprises:

a body (46) made fast with the framework (14);

a horizontal plate (45) guided slidably in a vertical direction across said body (46);

a pneumatic cylinder/piston assembly (48) acting between said body (46) and said plate (45);

a carriage (43) guided slidably across said plate (45); and clamps for clamping the knife (C) on the carriage (43).

* * * * *